US008418546B2

(12) United States Patent
Elshahawi et al.

(10) Patent No.: US 8,418,546 B2
(45) Date of Patent: Apr. 16, 2013

(54) IN-SITU FLUID COMPATIBILITY TESTING USING A WIRELINE FORMATION TESTER

(75) Inventors: Hani Elshahawi, Rutherford, NJ (US); Mohamed Naguib Hashem, Rijswijk (NL)

(73) Assignee: Shell Oil Company, Houston, TX (US)

( * ) Notice: Subject to any disclaimer, the term of this patent is extended or adjusted under 35 U.S.C. 154(b) by 305 days.

(21) Appl. No.: 12/743,393

(22) PCT Filed: Nov. 17, 2008

(86) PCT No.: PCT/EP2008/065635

§ 371 (c)(1),
(2), (4) Date: May 18, 2010

(87) PCT Pub. No.: WO2009/065793

PCT Pub. Date: May 28, 2009

(65) Prior Publication Data

US 2010/0242586 A1 Sep. 30, 2010

(30) Foreign Application Priority Data

Nov. 19, 2007 (EP) ..... 07121019

(51) Int. Cl.
*E21B 47/10* (2012.01)

(52) U.S. Cl.
USPC ..... 73/152.39

(58) Field of Classification Search ..... 73/152.51, 73/152.18, 152.23, 152.27, 152.39, 152.41
See application file for complete search history.

(56) References Cited

U.S. PATENT DOCUMENTS

| | | | | |
|---|---|---|---|---|
| 4,196,619 | A | 4/1980 | Collins | 73/155 |
| 4,353,249 | A | 10/1982 | Lagus et al. | 73/155 |
| 4,860,581 | A | 8/1989 | Zimmerman et al. | 73/155 |
| 5,353,637 | A | 10/1994 | Plumb et al. | 73/151 |
| 6,330,913 | B1 | 12/2001 | Langseth et al. | 166/250.01 |
| 7,296,462 | B2 * | 11/2007 | Gregory et al. | 73/152.51 |
| 7,367,395 | B2 * | 5/2008 | Vidrine et al. | 166/278 |
| 7,913,557 | B2 * | 3/2011 | Vasques et al. | 73/152.55 |
| 2004/0163811 | A1 * | 8/2004 | McKee et al. | 166/279 |
| 2006/0248949 | A1 * | 11/2006 | Gregory et al. | 73/152.51 |
| 2007/0284109 | A1 * | 12/2007 | East et al. | 166/305.1 |
| 2008/0156496 | A1 * | 7/2008 | East | 166/313 |
| 2009/0272531 | A1 * | 11/2009 | Montaron | 166/252.1 |

* cited by examiner

*Primary Examiner* — John Fitzgerald

(57) ABSTRACT

A method for performing fluid influx tests in a wellbore comprises inserting a well test device into the wellbore such that it separates a well test section from other sections of the wellbore;

performing a first fluid influx test during which fluid pressure in the test section is reduced, pore fluid is induced to flow into the test section and fluid influx into the test section is monitored;

injecting a completion fluid into the test section, and inducing the completion fluid to flow into the formation;

performing a second fluid influx test during which fluid pressure within the test section is reduced, completion and pore fluids are induced to flow into the test section, and fluid influx into the test section is monitored;

comparing fluid influx monitoring data acquired during the fluid influx tests to determine any effects of the completion fluid on formation pore fluid influx into the test section.

13 Claims, 1 Drawing Sheet

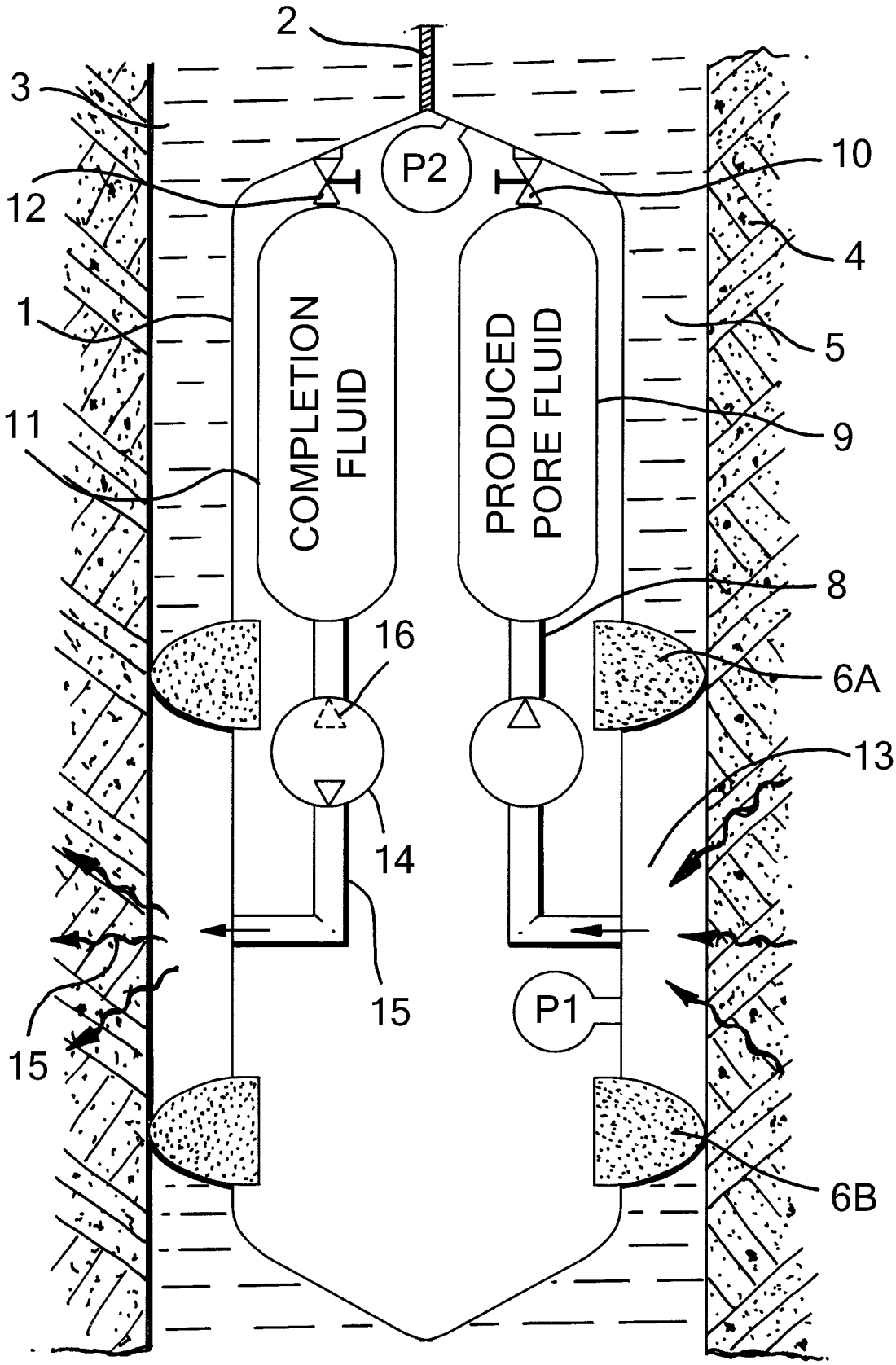
2
3
P2
10
12
4
1
5
COMPLETION FLUID
PRODUCED PORE FLUID
11
9
8
16
6A
13
14
15
P1
15
6B

IN-SITU FLUID COMPATIBILITY TESTING USING A WIRELINE FORMATION TESTER

PRIORITY CLAIM

The present application claims priority under 35 U.S.C. §371 to PCT Application EP2008/065635, filed 17 Nov. 2008, which claims priority to European Patent Application No. 07121019.9 filed 19 Nov. 2007.

BACKGROUND OF THE INVENTION

The invention relates to a method and device for performing fluid influx tests in a wellbore traversing a permeable formation.

It is known from U.S. Pat. Nos. 4,860,581 and 6,330,913 to perform a fluid inflow test in a wellbore traversing a permeable formation by:

a) inserting a well test device comprising a straddle packer assembly into the wellbore such that the straddle packer assembly separates a test section from other sections of the wellbore; and b) performing a fluid influx test during which the fluid pressure the test section is reduced, pore fluid is induced to flow from the pores of the permeable formation into the test section and fluid influx into the test section is monitored.

The known well test devices are usually used in wellbores that are filled with drilling mud using a downhole pump that works against the hydrostatic column to achieve so-called Low, reduced, or Zero shock sampling. The pumping is generally continued for a period of time, which is long enough to flush away drilling mud from the pores of the mud invaded zone of the formation in the vicinity of the test section of the wellbore.

The known well test devices are often used in exploration wells to obtain an early indication of the potential crude oil and/or natural gas production of an oil and/or natural gas containing formation surrounding the wellbore and if the well tests indicate that exploitable crude oil and or natural gas reserves are present formation samples are taken to assess in a laboratory which completion fluids are to be injected into the pores of the formation to stimulate crude oil and/or gas production and to inhibit skin effects due to reduced permeability of the formation surrounding the wellbore due to invasion of drilling mud and/or completion fluid.

It is an object of the present invention to provide a method and well test device for performing fluid influx tests in a wellbore traversing a permeable formation, which allow to test the compatibility of completion fluids in situ, without requiring taking of formation samples and testing these samples in a laboratory.

SUMMARY OF THE INVENTION

In accordance with the invention there is provided a method for performing fluid influx tests in a wellbore traversing a permeable formation, comprising:

a) inserting a well test device comprising a straddle packer assembly into the wellbore such that the straddle packer assembly separates a test section from other sections of the wellbore;

b) performing a first fluid influx test during which the fluid pressure the test section is reduced, pore fluid is induced to flow from the pores of the permeable formation into the test section and fluid influx into the test section is monitored;

c) injecting a first completion fluid into the test section, thereby increasing the fluid pressure within the test section and inducing the completion fluid to flow into the pores of the surrounding formation;

d) performing a second fluid influx test during which the fluid pressure within the test section is reduced, the first completion fluid and pore fluid are induced to flow into the test section, and fluid influx into the test section is monitored;

e) comparing fluid influx monitoring data acquired during the first and second fluid influx tests according to step b) and d) to determine any effects of the first completion fluid on the influx of formation pore fluid into the test section.

Optionally, the method further comprises:

f) injecting a second completion fluid into the test section, thereby increasing the fluid pressure within the test section and inducing the second completion fluid to flow into the surrounding formation;

g) performing a third production test during which the fluid pressure within the test section is reduced, completion fluid and pore fluid are induced to flow into the test section, and fluid influx into the test section is monitored;

h) comparing fluid influx monitoring data acquired during the first, second and third fluid influx tests according to steps b),d) and g) to determine any effects of the injected first and second completion fluids on the fluid influx into the test section;

i) selecting from the comparison according to step h) the most suitable completion fluid; and j) injecting during subsequent well completion operations the selected most suitable completion fluid into the permeable formation surrounding the wellbore.

The method according to the invention may be used to test the performance of a range of n completion fluids by:

k) injecting an n-th completion fluid into the test section, thereby increasing the fluid pressure within the test section and inducing the n-th completion fluid to flow into the surrounding formation;

l) performing a (n−1)th fluid influx test during which the fluid pressure within the test section is reduced, the n-th completion fluid and pore fluid are induced to flow into the test section, and fluid influx into the test section is monitored;

m) comparing fluid influx monitoring data acquired during the first, second, third, and (n−1)th fluid influx tests according to steps b), d), g) and l) to determine any effects of the injected first, second, third and n-th completion fluids on the fluid influx into the well;

n) selecting from the comparison according to step m) the most suitable completion fluid; and o) injecting during subsequent well completion operations the most suitable completion fluid selected in accordance with step m) into the pores of the formation.

During each of the fluid influx tests the wellbore may be substantially filled with a drilling fluid and the pressure in the test section may be reduced to a selected value by a pump which pumps fluid from the test section into an adjacent wellbore section, and the pressure within the test section, the fluid influx velocity and/or the composition of the fluid flowing from the formation into the test section are monitored.

The composition of the produced fluid flowing from the formation into the test section during each of the fluid influx tests may be monitored by pumping a sample of produced fluid into a sampling container, which is connected to the well test device.

The first second, third and n-th completion fluids may be stored in completion fluid storage containers which are connected to the well test device that may be suspended from a wireline in the wellbore of an exploration well.

The well test device may be maintained within the same section of the wellbore during each of the fluid influx tests, or it may be moved in longitudinal direction through the wellbore between the second, third, and n-th production tests to another section of the wellbore that traverses the permeable formation, which other section is not invaded by the completion fluid injected during a preceding well influx test.

The well test method according to the invention may be used to test the performance of a stimulation fluid that is configured to enhance production of hydrocarbon fluid from the formation.

The well test method according to the invention may also be used to test the performance of a sealing fluid, that is configured to seal off a thief zone to inhibit influx of an aqueous or another undesired fluid into a hydrocarbon production well.

In accordance with the invention there is also provided a well test device for use in the production testing method according to the invention, comprising:

a straddle packer assembly;

a pump for reducing the fluid pressure in a test section formed in use between the packers of the straddle packer assembly and a section of a hydrocarbon containing formation traversed by a wellbore in which the production testing tool is suspended;

means for injecting a completion fluid into the test section; and means for monitoring fluid influx into the test section during each production test.

The means for injecting a completion fluid into the test section may comprise a container for storing a completion fluid and a pump for injecting the completion fluid via the test section into the formation during a production test.

The means for injecting a completion fluid into the test section may comprise a plurality of containers in which different completion fluids are stored, such that different completion fluids can be injected into the formation to carry out a sequence of production tests in which the effects of each completion fluid on fluid influx into the test section is assessed.

These and other features, embodiments and advantages of the method and well test device according to the invention are described in the accompanying claims, abstract and the following detailed description of a preferred embodiment in which reference is made to the accompanying drawing.

BRIEF DESCRIPTION OF THE DRAWING

FIG. 1 is a schematic longitudinal sectional view of a well test device according to the invention in a wellbore.

DETAILED DESCRIPTION OF A PREFERRED EMBODIMENT

FIG. 1 shows a well test device 1 according to the invention, which is suspended from a wireline 2 in a wellbore 3.

The wellbore 3 traverses a permeable formation 4 and is filled with a high density drilling mud 5, which inhibits pore fluid from the formation 4 to flow into the wellbore.

The well test device 1 comprises a straddle packer assembly 6 comprising an upper and a lower inflatable packer 6A and 6B that are inflated when the device 1 has reached a region of the permeable formation 1 in which a fluid influx test is to be carried out.

The inflated packers 6A and 6B then seal off an annular teat section 13 of the wellbore 3 in which the fluid pressure is lowered by inducing a pump 7 to extract fluid from the annular section 13 and to pump this fluid via a conduit 8 and produced pore fluid collection container 9 into the mud filled section of the wellbore 3 above the test device 1. Pumping is continued long enough to allow drilling mud to be flushed away by the produced pore fluid from the pores of the formation 4 in the vicinity of the wellbore 3. Throughout the pumping operation the pressure within the annular test section 13 is monitored by a first pressure gauge P1 and the pressure in the wellbore above the well test device 1 is monitored by a second pressure gauge P2. By analyzing the transient pressure response, this will yield a base or reference reservoir permeability/mobility.

If the pressure difference between the pressures monitored by the first and second pressure gauges P1 and P2 has reached a constant plateau level, then this may be used as an indication that drilling mud 5 has been flushed away from the pores of the formation 4 in the vicinity of the wellbore 3 and then a valve 10 above the produced pore fluid collection container 9 is closed so that a sample of the produced pore fluid is collected in the produced pore fluid collection container 9 that is subsequently brought to surface when the well test device 1 is retrieved from the wellbore 3 so that the collected pore fluid can be analysed in a laboratory to detect whether the formation 4 comprises exploitable quantities of crude oil and/or natural gas.

The well test device 1 according to the invention is furthermore equipped with a completion fluid storage container 11 in which a sample of a contemplated completion fluid is stored. After completion of the well influx test described above completion fluid is pumped into the annular test section 13 by opening a valve 12 and inducing a pump 14 to pump completion fluid via a completion fluid injection conduit 14 and the annular test section 13 into the pores of the surround formation as illustrated by arrows 15. As soon as all completion fluid has been injected into the annular test section 13 and pores of the formation the pump 14 is stopped and the completion fluid is permitted to react with and/or otherwise treat the walls of the grains of the permeable formation 4 and/or the pore fluid within the pores of the formation 4.

Then the pumping action of the pump 14 is reversed as illustrated by arrow 16 and a mixture of completion fluid and pore fluid is induced to flow from the pores of the formation 4 via the annular test section 13, conduit 15 and pump 14 into the completion fluid storage container 11.

During this back production of the completion fluid the pressure difference between the annular test section 13 and the mud filled upper section of the wellbore 3 is monitored by the pressure gauges P1 and P2 and compared with the pressure difference monitored by the pressure gauges P1 and P2 during the preceding well influx test.

If the monitored pressure difference has increased after injection of the completion fluid then this is an indication that the tested completion fluid has fluid flux inhibiting properties and may be used as a sealant to seal off permeable thief zones through which water may flow into a crude oil and/or gas production well.

If the monitored pressure increase has decreased after injection of the completion fluid then this is an indication that the tested completion fluid has fluid flux stimulating properties and may be used to stimulate oil and/or gas production from the formation 4.

The well test device 1 according to the invention may be equipped with a plurality of completion fluid storage containers 11 that contain different completion fluids, which may be injected into and produced back from the pores of the formation 4 surrounding the test section 13 in the same manner as described above to test the performance of different completion fluids in the same test section 13. Alternatively, different completion fluids may be tested in different test sections 13 along the length of the wellbore 3 by lowering or raising the well test device 1 through the wellbore 3 after completion of each test.

The well test device 1 according to the invention enables testing for the injectivity, compatibility, or utility of completion fluids or drilling fluids or any fluids.

Each tested completion or other fluid would be slowly injected into the pores of the permeable formation 4 in the same way as would be during the actual completion or drilling phase, except over a smaller interval. The completion fluid can then be flowed back, and the transient pressure analysis repeated to observe the change of the formation response and evaluate the utility of the tested completion fluid. For instance, if this were a stimulation fluid, then the fluid is appropriate and beneficial when progressive improvements are noted upon injection of the fluid. If negative damage is observed for a stimulation fluid, on the other hand, then we have an adverse reaction with that fluid and it should be eliminated from the potential choices of stimulation fluids to be used in this well. Different fluids can be compared using the same technique either in the same straddled interval or at a different one, and the one with the most positive reaction can be chosen.

The well test device 1 can also be used to test the control of thief zones while drilling that normally create well control problems. In such situation, the sealing fluids effectiveness can be tested by repeat flow/injection tests to show the reduction of the permeability of the formation 4 by the suggested treating fluids. The removal of such fluids can also be tested by testing the compatibility and effectiveness of a breaker and observing the return permeability back using flow back tests, in the same manner described above for the completion fluids compatibility.

The main application of the well test device 1 according to the invention is to test the compatibility of various fluid combinations with each other and with the reservoir rock. Such tests are important because formations with certain clays and/or special mineral content (e.g. volcanic ash) that could adversely react with specific acids or completion fluids. This invention enables performing several tests multiple times and well in advance of the actual completion phase. This allows sufficient time to analyze the data and select the optimal completion fluids for the completion phase. It also results in fewer failed completions/stimulations, earlier and greater production, as well as improved hydrocarbon recoveries.

Advantages of the method and well test device according to the invention include the ability to perform such testing under actual in situ temperature, pressure, and stress condition and using actual reservoir rocks and fluids. Obtaining this realistic combination is nearly impossible to perform today because testing real rocks with real fluids under real downhole conditions would be very difficult and expensive to perform in the laboratory. The method according to the invention circumvents these limitations by performing all the experiments downhole while closely replicating the downhole injection rates and flow regimes seen during the actual injection/stimulation operation. The well test device and method according to the invention can be used either in an open, uncased, test section 13 of the wellbore 3 (during the drilling phase) or through a casing. In the latter case, holes must first be punched through the casing to enable communication with the formation 4, which tends to reduce the flexibility of the well testing technique.

The utility of the well test device and method according to the invention is not limited to fluid compatibility testing. Several other issues/applications can be addressed using the well test method and device according to the invention. These include the following:

- Testing the effectiveness of a stimulation treatment.
- Sampling of tight (low permeability) reservoirs
- Sampling of highly viscous fluids.
- Evaluating the presence and effectiveness of a fracture treatment.
- Testing the stability of a formation with a proposed drilling fluid or completion brine.
- Testing the ability to control fluid loss in known thief zones for well control.
- Testing the compatibility of a given completion fluid with the formation fluids/rocks to see if the use of that particular completion fluid is beneficial or detrimental to the stability/productivity of the proposed completion.
- Testing the effectiveness of a stimulation treatment. Possible examples include xylene injection for organic acid removal, mud acid injection for sandstone stimulation, or hydrochloric acid injection for carbonate stimulation.
- Testing for wetting agents effectiveness, for condensate bank mobility by altering the rock wettability.
- Testing drilling fluids sealing ability and effectiveness, to control hazardous thief zones while drilling.
- Testing the effectiveness of a certain fracture slurry in propagating and/or keeping open an induced fracture.
- Sampling in tight (low permeability) formations which could be accomplished by first injecting fluid to fracture the formation and then retesting after injection.
- Sampling of highly viscous fluids which could involve the injection of a diluting agent of known (well-characterized) composition to lower the viscosity in the near-wellbore region and aid the sampling of these fluids, which can otherwise be difficult or impossible to sample.

In a field test with the device according to the invention, the straddle packers 6A and 6B were inflated using wellbore fluids until a pre-specified inflation pressure was obtained. The annular test section 13 between the inflated packers 6A and 6B was then decompressed using the pump 7 to confirm that a seal exists between the annular test section 13 and the borehole mud 5 in the remaining parts of the wellbore 3 above and below the well test device 1. The drilling mud in the annular test section 13 was then produced using the pump 7 until the flowing pressure monitored by pressure gauge P1 fell below the static formation pressure. The pressure was then allowed to build up. This was repeated a few times to get a stable formation pressure and to obtain initial indications of formation permeability. The pump 14 was then used to pump completion fluid into the formation 4 and record injectivity profiles. Pumping was then increased in speed and differential pressure in order to fracture the permeable rock formation 4. The subsequent completion fluid injectivity was again measured in order to assess the enhanced permeability due to the fracturing operation.

Then the pump 14 was reversed as indicated by arrow 16 and a mixture of injected completion fluid and pore fluid was produced and stored in the completion fluid storage container 11 while the pressure difference between the annular test space 13 and the wellbore above the well test device 1 was monitored by the pressure gauges P1 and P2. The field test indicated that the tested stimulation fluid had a positive effect on the production of crude oil and/or natural gas from the formation and is therefore suitable for use as a stimulation fluid in the test section 13.

It will be understood that the pumps 7 and 14 may be replaced by a single reversible pump, which may be connected to various produced pore fluid storage containers 9 and completion fluid storage containers 11 by a manifold.

It will also be understood that the influx of fluid into the annular test section 13 may be monitored not only by the pressure gauge P1 and by storing a fluid sample in each of the containers 9 and 11, but also by measuring the temperature of the fluid and the pressure drop across a flow restriction, such as the valves 10 and 12 to measure the gas content of the produced fluid, and also by measuring the composition of the produced fluid by means of a fluid composition meter arranged in one or each of the conduits 8 and 15. The injected completion fluid stored in the container 11 may comprise a fluorescent tracer and the amount of completion fluid injected through the conduit 15 into the formation and subsequently produced back through the conduit 15 may be monitored by a fluorescent tracer monitoring device, which monitors the amount of light emitted by the fluid flowing through the conduit 15.

It will further be understood that these and other features of the well test device and method according to the invention may be modified and/or used in various combinations.

What is claimed is:

1. A method for performing fluid influx tests in a wellbore traversing a permeable formation, comprising:

a) inserting a well test device comprising a straddle packer assembly into the wellbore such that the straddle packer assembly separates a test section from other sections of the wellbore;

b) performing a first fluid influx test during which the fluid pressure the test section is reduced, pore fluid is induced to flow from the pores of the permeable formation into the test section and fluid influx into the test section is monitored;

c) injecting a first completion fluid into the test section, thereby increasing the fluid pressure within the test section and inducing the completion fluid to flow into the pores of the surrounding formation;

d) performing a second fluid influx test during which the fluid pressure within the test section is reduced, the first completion fluid and pore fluid are induced to flow into the test section, and fluid influx into the test section is monitored;

e) comparing fluid influx monitoring data acquired during the first and second fluid influx tests according to step b) and d) to determine any effects of the first completion fluid on the influx of formation pore fluid into the test section.

2. The method of claim 1 wherein the first second, third and n-th completion fluids are stored in completion fluid storage containers which are connected to the well test device.

3. The method of claim 1 wherein the well test device tool is suspended from a wireline in the wellbore of an exploration well.

4. The method of claim 1 wherein the well test device is maintained within the same section of the wellbore during each of the fluid influx tests.

5. The method of claim 1 wherein the formation testing tool is moved in longitudinal direction through the wellbore between the second, third, and n-th production tests to another section of the wellbore that traverses the permeable formation, which other section is not invaded by the completion fluid injected during a preceding well influx test.

6. The method of claim 1 wherein the method is used to test the performance of a stimulation fluid that is configured to enhance production of hydrocarbon fluid from the formation.

7. The method of claim 1 wherein the method is used to test the performance of a sealing fluid, that is configured to seal off a thief zone to inhibit influx of an aqueous or another undesired fluid into a hydrocarbon production well.

8. The method of claim 1 wherein the method is used to determine any reactivity between the injected first and/or any further completion fluid and rock material of and/or pore fluid within the permeable formation and/or modification of the wettability of the rock material and/or reduction or other modification of the viscosity of the pore fluid by any solvents in the first and/or any further completion fluid and/or by any difference between the temperature of the first and/or further completion fluid and the pore fluid.

9. The method of claim 1 wherein the permeable formation contains pore fluid comprising crude oil and/or natural gas and wherein after performing fluid influx tests in accordance with claim 1 at least one tested completion fluid is injected into the wellbore and pore fluid comprising crude oil and/or natural gas is produced through the wellbore.

10. The method of claim 1, wherein the method further comprises:

f) injecting a second completion fluid into the test section, thereby increasing the fluid pressure within the test section and inducing the second completion fluid to flow into the surrounding formation;

g) performing a third production test during which the fluid pressure within the test section is reduced, completion fluid and pore fluid are induced to flow into the test section, and fluid influx into the test section is monitored;

h) comparing fluid influx monitoring data acquired during the first, second and third fluid influx tests according to steps b),d) and g) to determine any effects of the injected first and second completion fluids on the fluid influx into the test section;

i) selecting from the comparison according to step h) the most suitable completion fluid; and j) injecting during subsequent well completion operations the selected most suitable completion fluid into the permeable formation surrounding the wellbore.

11. The method of claim 10, wherein the method further comprises:

k) injecting an n-th completion fluid, wherein n is an integer and at least 4, into the test section, thereby increasing the fluid pressure within the test section and inducing the n-th completion fluid to flow into the surrounding formation;

l) performing a (n-1)th fluid influx test during which the fluid pressure within the test section is reduced, the n-th completion fluid and pore fluid are induced to flow into the test section, and fluid influx into the test section is monitored;

m) comparing fluid influx monitoring data acquired during the first, second, third, and (n-1)th fluid influx tests according to steps b), d), g) and l) to determine any effects of the injected first, second, third and n-th completion fluids on the fluid influx into the well;

n) selecting from the comparison according to step m) the most suitable completion fluid; and o) injecting during subsequent well completion operations the most suitable completion fluid selected in accordance with step m) into the pores of the formation.

12. The method of claim 1 wherein the during each of the fluid influx tests the wellbore is substantially filled with a drilling fluid and the pressure in the test section is reduced to a selected value by a pump which pumps fluid from the test section into an adjacent wellbore section, and the pressure within the test section, the fluid influx velocity and/or the composition of the fluid flowing from the formation into the test section are monitored.

13. The method of claim 12, wherein the composition of the produced fluid flowing from the formation into the test section during each of the fluid influx tests is monitored by pumping a sample of produced fluid into a sampling container, which is connected to the well test device.

* * * * *